US008683984B2

(12) United States Patent
Daublebsky von Eichhain

(10) Patent No.: US 8,683,984 B2
(45) Date of Patent: Apr. 1, 2014

(54) THERMOCOMPRESSION MOTOR

(71) Applicant: Christian Daublebsky von Eichhain, München (DE)

(72) Inventor: Christian Daublebsky von Eichhain, München (DE)

( * ) Notice: Subject to any disclaimer, the term of this patent is extended or adjusted under 35 U.S.C. 154(b) by 0 days.

(21) Appl. No.: 13/674,023

(22) Filed: Nov. 10, 2012

(65) Prior Publication Data

US 2013/0312676 A1 Nov. 28, 2013

Related U.S. Application Data

(63) Continuation of application No. PCT/EP2011/057609, filed on May 11, 2011.

(30) Foreign Application Priority Data

May 12, 2010 (DE) ..... 10 2010 020 325

(51) Int. Cl.
*F02G 5/00* (2006.01)

(52) U.S. Cl.
USPC ..... 123/543; 123/556; 123/68; 123/74 AC; 123/71 R

(58) Field of Classification Search
USPC ..... 123/543, 556, 68, 71 R, 74 AC
See application file for complete search history.

(56) References Cited

U.S. PATENT DOCUMENTS 1,882,971 A * 10/1932 Schimanek ..... 123/64
1,934,238 A * 11/1933 Schimanek ..... 123/1 R
3,591,958 A 7/1971 Nebgen
3,918,262 A 11/1975 Postma
4,085,588 A 4/1978 Reams et al.
4,333,424 A 6/1982 McFee
4,476,821 A 10/1984 Robinson et al.
5,857,436 A 1/1999 Chen (Continued)

FOREIGN PATENT DOCUMENTS

DE 2035605 A1 2/1971
DE 2209791 A1 9/1973

(Continued)

OTHER PUBLICATIONS

Examination Report for German Application No. 10 2010 020 325.4 issued by the German Patent and Trademark Office, dated Feb. 21, 2011.

(Continued)

*Primary Examiner* — Noah Kamen
*Assistant Examiner* — Grant Moubry
(74) *Attorney, Agent, or Firm* — Manfred Beck, P.A.

(57) ABSTRACT

A thermocompression motor includes a piston dividing a cylinder into a first and a second chamber and includes a heat exchanger having at least one air channel and at least one exhaust gas channel. In a first cycle, the first and second chamber are connected via the air channel, whereby air from the first chamber is pushed into the heat exchanger and heated air is conveyed from the heat exchanger into the second chamber. In a second cycle, fuel is burned in the second chamber. In a third cycle, only the connection of the second chamber to the exhaust gas channel is open during a subsequent volume increase of the first chamber. In a fourth cycle, fresh air is sucked into the first chamber during a further volume increase of the first chamber, while the connection between the first and second chamber via the air channel is interrupted.

19 Claims, 10 Drawing Sheets

(56) References Cited

U.S. PATENT DOCUMENTS

| | | | | |
|---|---|---|---|---|
| 5,899,177 | A | 5/1999 | Binversie et al. | |
| 6,220,030 | B1 | 4/2001 | Clucas et al. | |
| 6,463,731 | B1 | 10/2002 | Warren | |
| 6,694,942 | B1 | 2/2004 | Massmann et al. | |
| 7,140,182 | B2 * | 11/2006 | Warren | 60/712 |
| 2005/0166871 | A1 * | 8/2005 | Warren | 123/51 R |
| 2009/0013686 | A1 | 1/2009 | Yaguchi et al. | |

FOREIGN PATENT DOCUMENTS

| | | | |
|---|---|---|---|
| DE | 2405033 | A1 | 8/1975 |
| DE | 2538245 | A1 | 3/1976 |
| DE | 2706728 | A1 | 10/1977 |
| DE | 2926970 | A1 | 1/1981 |
| DE | 3429727 | A1 | 2/1986 |
| DE | 4024558 | A1 | 2/1992 |
| DE | 4134404 | A1 | 4/1993 |
| DE | 4340872 | A1 | 6/1994 |
| DE | 4302087 | A1 | 7/1994 |
| DE | 4418286 | A1 | 11/1995 |
| DE | 10239403 | A1 | 4/2003 |
| DE | 10083635 | B4 | 12/2007 |
| DE | 102007023295 | A1 | 11/2008 |
| DE | 102007062293 | A1 | 6/2009 |
| EP | 1053393 | A1 | 11/2000 |
| EP | 1126153 | A2 | 8/2001 |
| EP | 1979601 | A1 | 10/2008 |
| WO | 85/01988 | A1 | 5/1985 |
| WO | 93/08390 | A1 | 4/1993 |
| WO | 96/19649 | A1 | 6/1996 |
| WO | 03/046347 | A1 | 6/2003 |
| WO | 2005/003542 | A1 | 1/2005 |

OTHER PUBLICATIONS

International Search Report for International Application No. PCT/EP2011/057609 and translation thereof, completed Aug. 30, 2011.

International Preliminary Report on Patentability for International Application No. PCT/EP2011/057609 including Written Opinion of the International Searching Authority and translation thereof, dated Nov. 13, 2012.

* cited by examiner

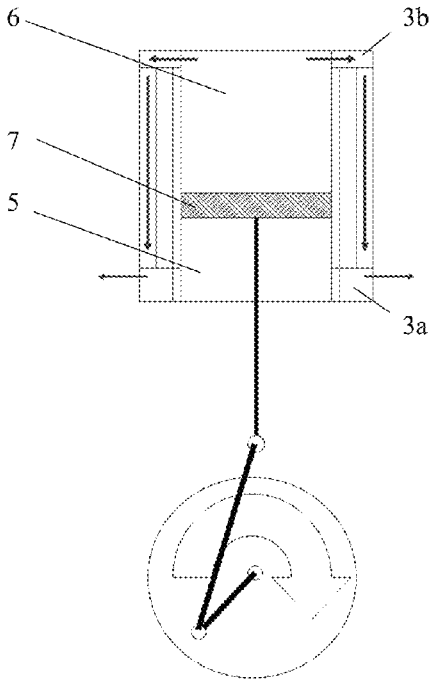
Fig. 6
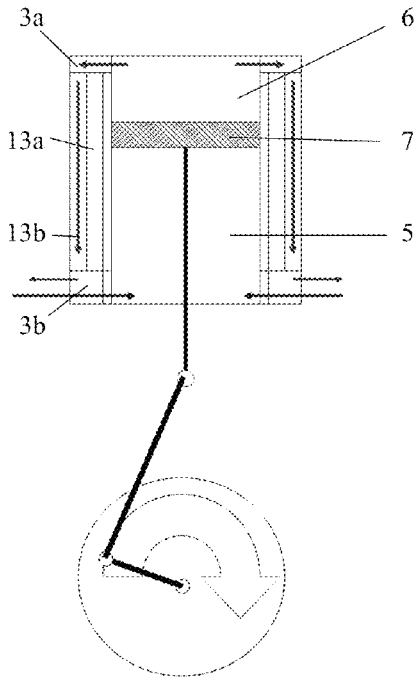
Fig. 7
| angle of rotation of piston | 360-0 | 60 | 120 | 180 | 240 | 300 |
|---|---|---|---|---|---|---|
| upper slide valve upper space to heat exchanger to outside | | | | open | | |
| upper slide valve from heat exchanger air side from lower space | open | | | | | |
| lower slide valve from outside to lower space | | | | | | open |
| lower slide valve from lower space to heat exchanger | open | | | | | |
(black = closed)
Fig. 8

| | Angle of Rotation | | | | |
|---|---|---|---|---|---|
| **Valve** | 0° –170° | 170° – 360° | 360° – 540° | 540° - 660° | 660° - 720° |
| 6 – 13b | closed | closed | closed | open | open |
| 13a - 6 | open | closed | closed | closed | closed |
| 22 - 5 | closed | closed | closed | closed | open |
| 5 – 13a | open | closed | closed | closed | closed |

Fig. 22

THERMOCOMPRESSION MOTOR

CROSS-REFERENCE TO RELATED APPLICATIONS

This application is a continuation, under 35 U.S.C. §120, of copending International Application No. PCT/EP2011/057609, filed May 11, 2011, which designated the United States; this application also claims the priority, under 35 U.S.C. §119, of German Patent Application No. DE 10 2010 020 325.4, filed May 12, 2010; the prior applications are herewith incorporated by reference in their entirety.

BACKGROUND OF THE INVENTION

Field of the Invention

Previous heat engines with an open cycle process (diesel process, Otto process and Joule process (gas turbine process)) have a high power density and a relatively high efficiency, because the working medium is sucked in from the environment outside and thus the lower temperature according to the law of Carnot from outside is used.

Heat engines, heating systems and associated valve control systems are for example known from German Patent Application Publication Nos. DE 27 06 726 A1, DE 29 26 970 A1, DE 10 2007 023 295 A1, U.S. Pat. No. 5,899,177, German Patent Application Publication Nos. DE 10 2007 062 293 A1, DE 25 282 45 A1, DE 41 34 404 A1, DE 24 05 033 A1, DE 102 39 403 A1, DE 100 83 635 A1, DE 2035605 A1, DE 3429727 A1, DE 4024558 A1, DE 4302087 A1, DE 4340872 A1, DE 4418286 A1, European Patent Application Publication Nos. EP 1053393 A1, EP 1126153 A2, EP 1979601 A1, International Publication Nos. WO 1985001988 A1, WO 1993008390 A1, WO 1996019649 A1, WO 2003046347 A1 and WO 2005003542 A1.

Heat is supplied with the internal combustion. Therefore, in principle, no heat exchanger is necessary. The motor cooling has more mechanical reasons and permits a simple lubricating of the cylinder walls. A disadvantage is that the exhaust gas temperatures of the open cycle processes are relatively high and are discharged mostly unused as loss through the exhaust or flue.

In case of closed cycle processes heat exchangers are needed. Heat exchangers work with a temperature difference, have a finite size and require at high temperatures, which are a prerequisite for high efficiencies, high quality materials. Therefore, in these thermal cycle processes, such as the Stirling process or Rankine process or, respectively, steam power plant process, the efficiency is often limited by the material of the heat exchanger, the material usually being steel.

Still another disadvantage of the open thermal cycle processes is that a large mechanical expenditure must be undertaken, in order to generate a high compression. In case of an external heat supply and a closed process, a relatively large expenditure with respect to the technical equipment must be undertaken, in order to supply or, respectively, remove the heat in heat exchangers. However, relatively high efficiencies can be obtained as a result.

German Patent Application Publication No. DE 22 09 791 A discloses a heat engine in the form of a reciprocating double piston machine that includes a cylinder which is divided by a piston into an upper and a lower chamber. Via the lower chamber, fresh air is sucked in and is precompressed, while the upper chamber serves for the expansion of an oxygen-containing hot gas. The lower and upper chambers are connected to one another via valve-controlled heater tubes, which are arranged outside the cylinder. In the lower chamber, precompressed gas is brought to a higher pressure in heater tubes by means of an external heat source and is then supplied to the upper chamber in a cyclical manner. An external burner with continuous combustion serves as a heat source. After its expansion, the gas expelled from the upper chamber is then supplied to the burner as combustion air, so that the heat engine known from German Patent Application Publication No. DE 22 09 791 A works practically with an external combustion.

Furthermore, a combustion engine with an upstream compressor is known from U.S. Pat. No. 4,333,424 A. The precompressed air coming from the compressor is passed through a heat exchanger and there it is heated by the combustion gases of the combustion engine. The precompressed and heated air subsequently passes into the combustion chamber of a cylinder-piston unit, in order to burn fuel supplied thereto during a power cycle. The exhaust gases of the cylinder-piston-unit are passed through the heat exchanger prior to entering the environment.

SUMMARY OF THE INVENTION

It is accordingly an object of the invention to provide a thermocompression motor and a method for operating a thermocompression motor which overcome the above-mentioned disadvantages of the heretofore-known heat engines of this general type. Specifically, it is an object of the invention to combine the advantages of the open cycle process with the advantages of the closed cycle processes in a relatively simple heat engine by using the heat of the exhaust gases in the interior of the machine.

With the foregoing and other objects in view there is provided, in accordance with the invention, a thermocompression motor, including:

a cylinder;

a piston, which is disposed reciprocatingly movable in the cylinder and which divides the cylinder into a first chamber and a second chamber;

a heat exchanger having at least one air channel, which connects the first chamber with the second chamber, and having at least one exhaust gas channel, which connects the second chamber with an external environment, the at least one air channel and the at least one exhaust gas channel being disposed with respect to one another to allow a heat exchange;

an intake device via which the first chamber is connected to the external environment; and valve devices for controlling inflows and outflows in the first chamber and the second chamber of the cylinder and in the at least one air channel and the at least one exhaust gas channel of the heat exchanger, the valve devices being controlled such that the following cycles are carried out in succession, namely:

in a thermocompression cycle as a first cycle, during a volume reduction of the first chamber, the first chamber is connected with the second chamber via the at least one air channel, whereby air from the first chamber is expelled into the heat exchanger and heated air from the heat exchanger is conveyed into the second chamber, an inflow via the intake device into the first chamber as well as an outflow from the second chamber into the at least one exhaust gas channel is however interrupted;

subsequently, in a second cycle, during a volume reduction of the first chamber, a connection between the at least one air channel and the second chamber is closed and fuel that has been introduced is burned in the second chamber, wherein an inflow to the first chamber is still interrupted;

in a third cycle, during a subsequent volume increase of the first chamber, only a connection of the second chamber to the at least one exhaust gas channel is open; and in a fourth cycle, during a further volume increase of the first chamber, an inflow thereto via the intake device is opened, while a connection between the first chamber and the second chamber via the at least one air channel is interrupted.

In other words, according to the invention, there is provided a thermocompression motor that includes a cylinder, a piston, which is disposed reciprocatingly movable in the cylinder and which divides the cylinder into a first chamber and a second chamber, a heat exchanger with at least one air channel which connects the first chamber with the second chamber, and at least one exhaust gas channel which connects the second chamber with the external environment, wherein the at least one air channel and the at least one exhaust gas channel are arranged with respect to one another to allow a heat exchange, an intake device via which the first chamber is connected to the external environment, and valve devices for controlling the inflows and outflows in the chambers of the cylinder and in the channels of the heat exchanger. The valve devices are in this case controlled in such a manner that the following cycles are carried out in succession, namely such that:

in a first cycle or, respectively, thermocompression cycle during a volume reduction of the first chamber the first chamber is connected with the second chamber via the at least one air channel, whereby air from the first chamber is expelled into the heat exchanger and heated air from the heat exchanger is conveyed into the second chamber, an inflow via the intake device into the first chamber as well as an outflow from the second chamber into the at least one exhaust gas channel is however interrupted, subsequently, in a second cycle, during a volume reduction of the first chamber the connection between the at least one air channel and the second chamber is closed and fuel that has been introduced is burned in the second chamber, wherein the inflow to the first chamber is still interrupted, in a third cycle during a subsequent volume increase of the first chamber only the connection of the second chamber to the exhaust gas channel is open, and in a fourth cycle during a further volume increase of the first chamber the inflow via the intake device is opened, while the connection between the first and second chamber via the at least one air channel is interrupted.

As a result, a very high efficiency is achieved. In a simulation calculation with a maximum heat exchanger temperature of 1,000° C. and a maximum internal temperature of 1,700° C. an efficiency of approximately 70% has been calculated.

According to another feature of the invention, a compression cycle is inserted between the first cycle and the second cycle, in which for a reciprocating movement of the piston all of the valve devices are kept closed, and a combustion in the second cycle starts shortly before a dead center of the piston, at the dead center of the piston or after overcoming the dead center of the piston.

The control of the valve devices can be carried out such that for each reciprocating movement of the piston a power cycle is carried out, in which fuel in the second chamber is burned. It is however also possible to insert, between the first cycle and the second cycle, a compression cycle in which for a reciprocating movement of the piston all valve devices are kept closed, and the combustion in the second cycle starts after overcoming the dead center of the piston. In this case a power cycle is performed only for every other reciprocating back and forth movement of the piston. However, a longer stroke is available for the power cycle, because the combustion in the second cycle can begin sooner, for example, already shortly before, at, or shortly after the dead center of the piston at the maximum volume of the first chamber and the minimum volume of the second chamber.

According to another feature of the invention, the first chamber has a given residual space at a dead center of the piston at a minimum volume of the first chamber. In other words, preferably a defined residual space remains in the first chamber at the dead center of the piston when there is a minimum volume of the first chamber, so that the compressed air acts as a gas spring.

According to another feature of the invention, the valve devices are controlled such that at a transition from the second cycle to the third cycle the connection of the second chamber to the at least one exhaust gas channel is opened at or after a dead center at a minimum volume of the first chamber, when a pressure in the second chamber is equal to a pressure after the at least one exhaust gas channel of the heat exchanger. In other words, according to a further advantageous embodiment, the valve devices are controlled such that at the transition from the second cycle to the third cycle, the connection of the second chamber to the at least one exhaust gas channel is opened at or after the dead center at a minimum volume of the first chamber, when the pressure in the second chamber is equal to the pressure after the exhaust gas channel of the heat exchanger. Expulsion losses are thus kept low.

According to yet another feature of the invention, the valve devices are controlled such that in the fourth cycle, a connection to the intake device is opened when a pressure in the first chamber is equal to a pressure in front of a corresponding one of the valve devices. In other words, according to a further advantageous embodiment, the valve devices are controlled such that in the fourth cycle the connection to the intake device is opened when the pressure in the first chamber is equal to the pressure in front of the corresponding valve device or when a defined position of the piston in the cylinder is reached. Losses during the gas exchange are thus avoided.

According to another feature of the invention, at least one of the valve devices is embodied as a slide valve.

According to a further feature of the invention, one of the valve devices is embodied as a slide valve controlling both an inflow and an outflow of the first chamber.

According to a yet another feature of the invention, one of the valve devices is embodied as a slide valve controlling both an inflow and an outflow of the second chamber.

According to another feature of the invention, the valve devices are embodied as a first slide valve and a second slide valve, the first slide valve controls both an inflow and an outflow of the first chamber and the second slide valve controls both an inflow and an outflow of the second chamber.

The valve devices can be implemented in any arbitrary construction. In particular, valves controlled by a crankshaft or a camshaft can be used. Further, individually controllable magnetic valves can be used. According to an advantageous embodiment, slide valves are used. In a particular variant embodiment, a first slide valve, which controls both the inflow and outflow of the first chamber, and/or a second slide valve, which controls both the inflow and outflow of the second chamber, can be provided. This results in a particularly simple construction.

According to another feature of the invention, the valve devices are embodied as a first slide valve and a second slide valve, the first slide valve controls both an inflow and an outflow of the first chamber and the second slide valve controls both an inflow and an outflow of the second chamber; the heat exchanger is fixedly connected to at least one of the slide valves and is disposed rotatably around the cylinder; and the cylinder has a cylinder wall, a base and a cover, wherein the cylinder wall and/or the base and/or the cover has openings formed therein, and a gas exchange through corresponding ones of the openings is controlled in dependence of a rotational position of the heat exchanger with respect to the cylinder. In other words, in a further advantageous embodiment, the heat exchanger is fixedly connected to at least one of the slide valves and is arranged rotatably around the cylinder. The gas exchange can in this case be controlled in a very simple manner by corresponding openings in the cylinder wall or, respectively, in a base and/or cover of the cylinder in dependence of the rotational position of the heat exchanger with respect to the cylinder.

According to another feature of the invention, a microprocessor-controlled device is provided for metering a quantity of supplied fuel as a function of an expulsion temperature, wherein the expulsion temperature is a temperature of exhaust gas during expulsion from the second chamber into the at least one exhaust gas channel of the heat exchanger. In other words, according to a further advantageous embodiment of the invention, the quantity of supplied fuel is metered by a microprocessor-controlled device as a function of the expulsion temperature, i.e. the temperature of the exhaust gas during expulsion from the second chamber into the at least one exhaust gas channel of the heat exchanger. This makes it possible to achieve a further improvement in efficiency. The heat exchanger is used optimally on the exhaust gas side. In addition, damage of the heat exchanger, for example by overheating, is reliably avoided.

According to another feature of the invention, the intake device is a microprocessor-controlled intake device for metering a quantity of fresh air supplied to the first chamber as a function of an ambient constant pressure, wherein the metering occurs such that a combustion gas has a pressure after an expansion equal to a pressure after the heat exchanger. In other words, the quantity of fresh air supplied to the first chamber is preferably metered by a microprocessor-controlled intake device as a function of the ambient constant pressure such that the combustion gas has the same pressure after the expansion as after the heat exchanger. The efficiency can also be further increased as a result. In particular, the exhaust gas pressure is optimally utilized. In addition, operating noises are minimized.

According to another feature of the invention, the thermocompression motor has a piston rod connected to the piston, a cooling channel running through the piston rod and the piston, the cooling channel having a first opening in a region of the first chamber and having at least a second opening in a region of the second chamber, the cooling channel extending from the first opening in the region of the first chamber to the second opening in the region of the second chamber, and a check valve disposed in the cooling channel, the check valve being configured to prevent a backflow from the second chamber into the first chamber. In other words, according to a further advantageous embodiment of the invention, the piston is connected to a piston rod, wherein a cooling channel runs through the piston rod and the piston. The cooling channel extends from an opening in the region of the first chamber to at least one opening in the region of the second chamber. Furthermore, a check valve is arranged in the cooling channel, the check valve preventing a backflow from the second chamber into the first chamber. A piston cooling is thus achieved in a simple manner.

According to a further feature of the invention, the thermocompression motor has a piston rod connected to the piston, a cooling channel running through the piston rod and the piston, the cooling channel having an opening in a region of the first chamber and having a plurality of openings in a region of the second chamber, the cooling channel extending from the opening in the region of the first chamber to the plurality of openings in the region of the second chamber. A check valve is disposed in the cooling channel, the check valve being configured to prevent a backflow from the second chamber into the first chamber. The cylinder has an inner wall and at least one of the plurality of openings in the region of the second chamber is directed toward the inner wall of the cylinder. In other words, preferably at least one of the openings of the cooling channel into the second chamber is directed toward the inner wall of the cylinder, so that also the cylinder can be cooled.

According to a further feature of the invention, the cylinder has a jacket with channels extending therethrough, the channels form a cylinder cooler, the channels connect the first chamber with the second chamber and are flowed through by a partial flow of air from the first chamber in the first cycle, wherein the valve devices assigned to the at least one air channel control a flow. In other words, according to a further advantageous embodiment of the invention, a cylinder cooler is provided in the form of channels extending through the jacket of the cylinder for cooling the cylinder. These channels connect the first chamber with the second chamber and are, in the first cycle, flowed through by a partial flow of the air from the first chamber. The flow is preferably controlled by the valve devices assigned to the at least one air channel. A particularly efficient cooling is achieved as a result. Moreover, the waste heat is used in addition to the thermocompression, whereby the efficiency is further improved.

According to another feature of the invention, the cylinder has a jacket with channels extending therethrough, the channels form a cylinder cooler, the channels connect the first chamber with the at least one air channel of the heat exchanger, wherein a total flow of air from the first chamber is guided over the cylinder cooler, wherein the valve devices assigned to the at least one air channel control a flow. According to yet another feature of the invention, the cylinder has a jacket with channels extending therethrough, the channels form the at least one air channel connecting the first chamber with the second chamber, the channels form a cylinder cooler, wherein a total flow of air from the first chamber is guided over the cylinder cooler, wherein the valve devices assigned to the at least one air channel control a flow. In other words, a cylinder cooler is provided in the form of channels extending through the jacket of the cylinder, the channels connect the first chamber with the air channel of the heat exchanger or form the air channel, wherein the total flow of the air from the first chamber is guided over the cylinder cooler and the flow is controlled by the valve devices assigned to the at least one air channel.

Thus, alternatively, the channels extending through the jacket of the cylinder can be connected in series with the at least one air channel, so that the total flow of the air from the first chamber is guided over the cylinder cooler and the flow is controlled by the valve devices assigned to the at least one air channel. The cooling effect and the utilization of the waste heat are hereby further improved.

According to another feature of the invention, the valve devices and the heat exchanger are disposed within a radial annular space flat around an outer periphery of the cylinder. In other words, according to a further advantageous embodiment of the invention, the valve devices and the heat exchanger are arranged within a radial annular space around the outer periphery of the cylinder, so that a particularly compact construction of the motor is the result.

With the objects of the invention in view there is also provided, a method for operating a thermocompression motor, including the steps of:

providing a piston disposed reciprocatingly movable in a cylinder, wherein the piston divides the cylinder into a first chamber and a second chamber;

providing a heat exchanger with at least one air channel, which connects the first chamber with the second chamber, and with at least one exhaust gas channel, which connects the second chamber with an external environment, wherein the at least one air channel and the at least one exhaust gas channel are disposed with respect to one another to allow a heat exchange;

providing an intake device via which the first chamber is connected to the external environment; and providing valve devices for controlling inflows and outflows in the first chamber and the second chamber of the cylinder and in the at least one air channel and the at least one exhaust gas channel of the heat exchanger, wherein the valve devices are controlled such that the following cycles are carried out in succession:

in a thermocompression cycle as a first cycle, connecting, during a volume reduction of the first chamber, the first chamber with the second chamber via the at least one air channel, whereby air from the first chamber is expelled into the heat exchanger and heated air from the heat exchanger is conveyed into the second chamber, an inflow via the intake device into the first chamber as well as an outflow from the second chamber into the at least one exhaust gas channel is however interrupted;

subsequently, in a second cycle, keeping a connection between the at least one air channel and the second chamber closed during a volume reduction of the first chamber and burning fuel, which has been introduced, in the second chamber, wherein an inflow to the first chamber is still interrupted;

in a third cycle, keeping only a connection of the second chamber to the at least one exhaust gas channel open during a subsequent volume increase of the first chamber; and in a fourth cycle, during a further volume increase of the first chamber, opening an inflow to the first chamber via the intake device, while interrupting a connection between the first chamber and the second chamber via the at least one air channel.

Other features which are considered as characteristic for the invention are set forth in the appended claims.

Although the invention is illustrated and described herein as embodied in a thermocompression motor, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 6 is a schematic illustration of a motor according to the invention at cycle 3;

FIG. 7 is a schematic illustration of a motor according to the invention at cycle 4;

FIG. 8 is a table illustrating the valve positions in dependence of the piston position with reference to a crankshaft revolution of 360°;

FIG. 22 is a table illustrating the valve positions in dependence of the piston position with reference to two crankshaft revolutions of 720°.

DETAILED DESCRIPTION OF THE INVENTION

Figure 1:
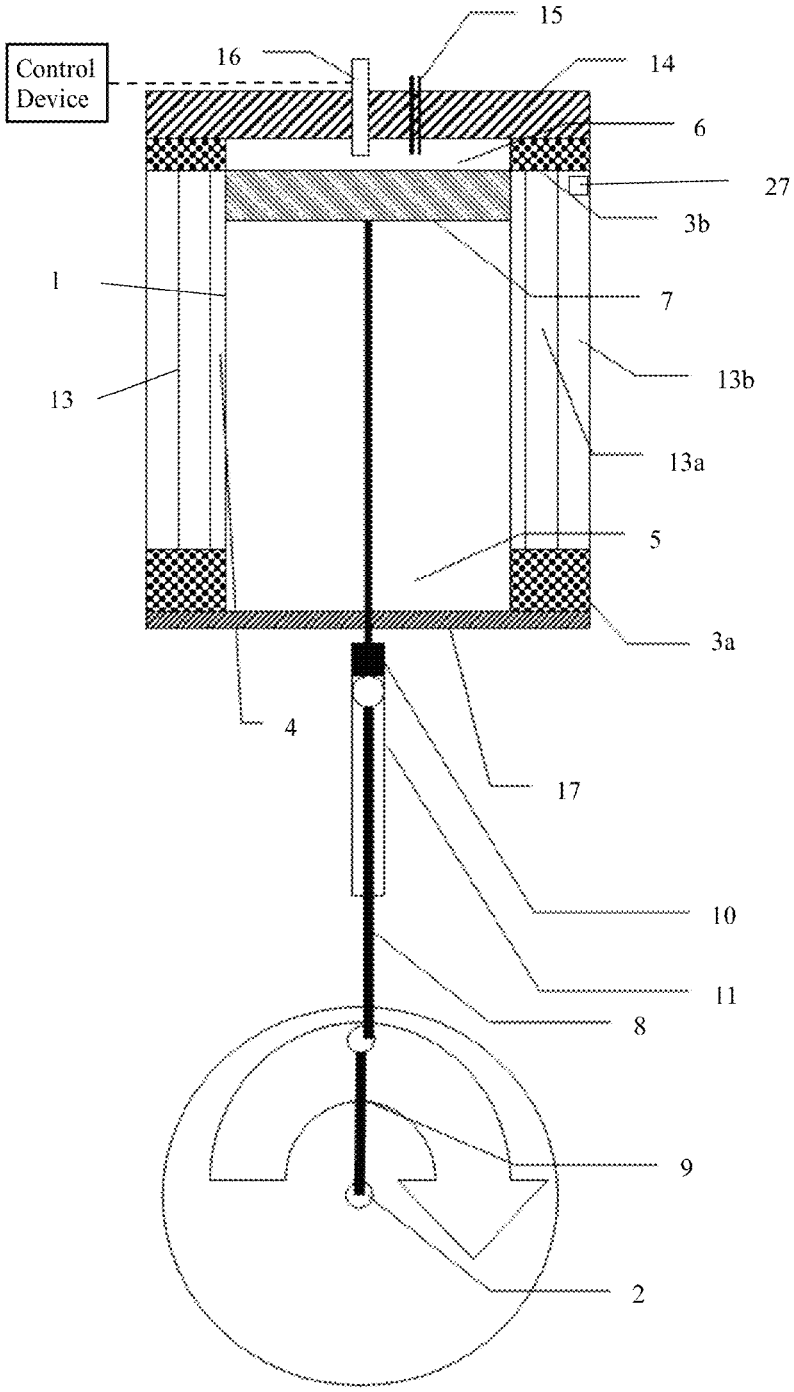
FIG. 1 is a diagrammatic sectional view of a motor according to a first exemplary embodiment of the invention.

Referring now to the figures of the drawings in detail and first, particularly, to FIG. 1 thereof, there is shown a preferred exemplary embodiment of a thermocompression motor according to the invention which is formed essentially of a cylinder 1 with a piston 7 moving upward and downward in the cylinder, wherein the piston is heat-insulated towards the top, and a crankshaft 2 with crank webs 9, wherein the crankshaft is connected to a connecting rod 8 via a joint. The piston 7 is linearly guided with a piston rod and a crosshead 10 and a crosshead guide 11.

The cylinder 1 is closed with an upper cover 14, which is insulated towards the interior. The cylinder 1 is also closed with a lower cover 17.

Figure 12:
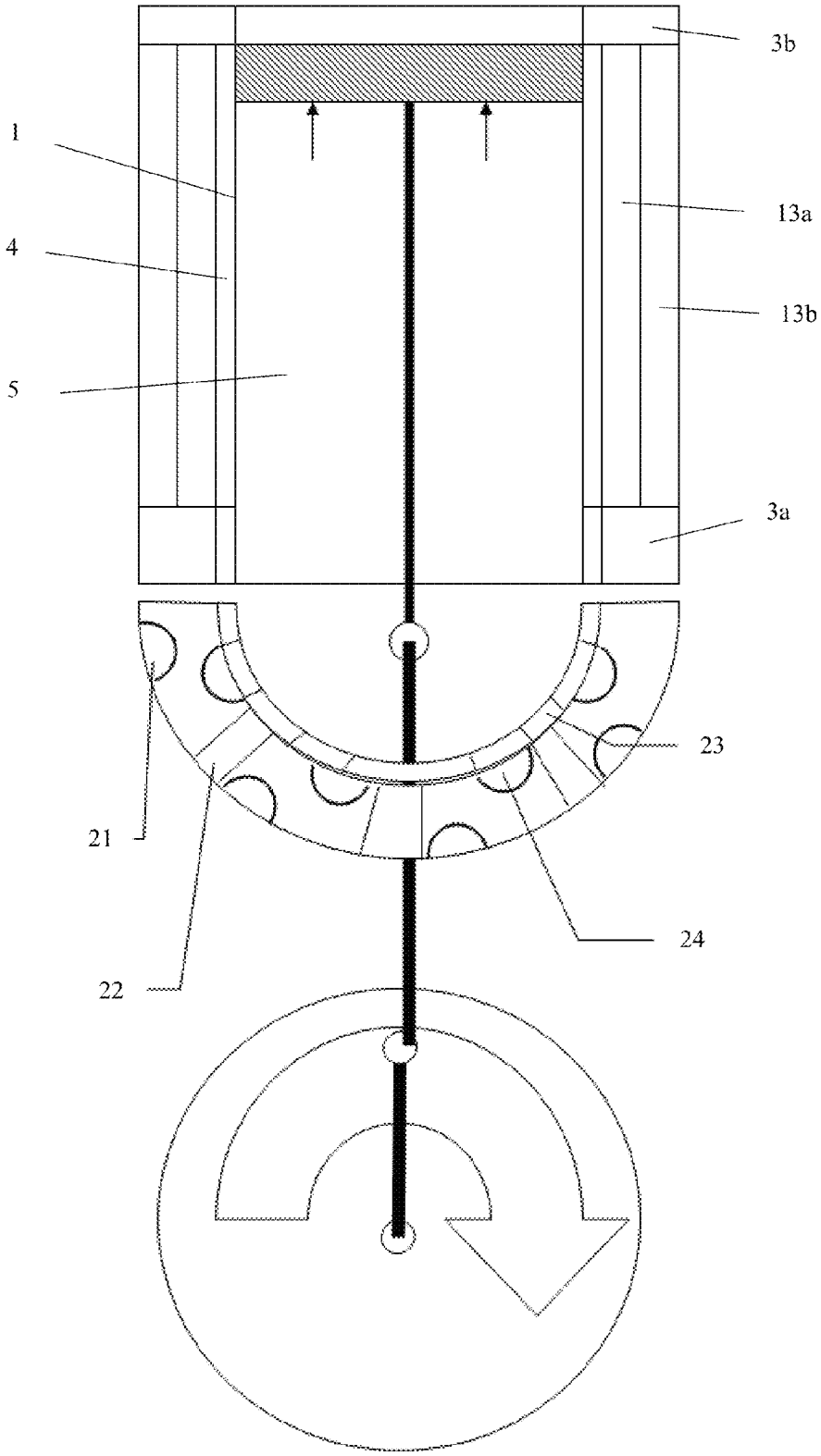
FIG. 12 is a schematic illustration of a motor according to the invention for schematically illustrating a rotationally symmetric first slide valve.

The piston 7 divides the interior space of the cylinder into a first chamber 5 and a second chamber 6. The volume of the two chambers changes in dependence of the piston position. The air intake into the first chamber, in FIG. 1 the lower chamber 5 of the cylinder 1, and the displacement of the air from the first chamber 5 into the second chamber, in FIG. 1 the upper chamber 6 of the cylinder 1, is controlled by valve devices. In the first exemplary embodiment, a lower first slide valve 3*a* is provided for this purpose, which is shown in detail in FIG. 12. The first slide valve 3 is driven by the crankshaft 2.

The displacement of the exhaust gas from the upper second chamber 6 of the cylinder 1 and the receiving of the preheated air from a heat exchanger 13 is controlled by further valve devices. In the first exemplary embodiment, an upper second slide valve 3*b* or, respectively, exhaust gas slide valve is provided.

The slide valves 3*a* and 3*b* are driven by the crankshaft 2 via toothed belts or chains or bevel drive shaft and gearwheels. Appropriate drives are sufficiently known. A crankshaft revolution does not necessarily have to be a complete slide valve revolution.

A heat exchanger 13 is arranged between the slide valves 3*a* and 3*b*. The heat exchanger 13 has an exhaust gas side with at least one exhaust gas channel 13*b*, which connects the second chamber 6 with the external environment, and has an air side with at least one air channel 13*a*, which connects the first chamber 5 with the second chamber 6. The heat exchanger 13 is not fixedly connected to the cylinder wall, in order to avoid thermal strains. As a result it can furthermore be prevented that the slide valves 3*a* and 3*b* get "jammed" by the thermal expansion.

Here, the heat exchanger 13 is fixedly connected with the slide valves 3*a* and 3*b* and is arranged rotatable around the cylinder 1. The gas exchange is controlled by appropriate openings 22 in the cylinder wall, if applicable also in the base 17 and/or cover 14 of the cylinder 1, depending on the rotational position of the heat exchanger 13 with respect to the cylinder 1.

Figure 9A:
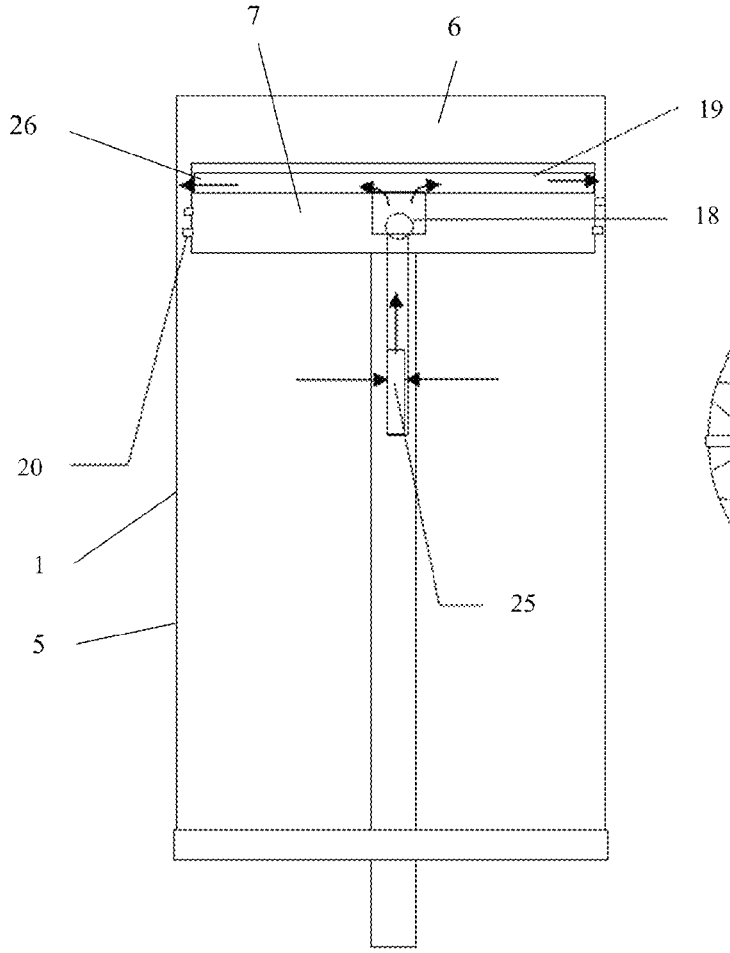
FIG. 9A is a schematic view of an exemplary embodiment of a motor according to the invention illustrating the piston and cylinder running surface cooling.
Figure 9B:
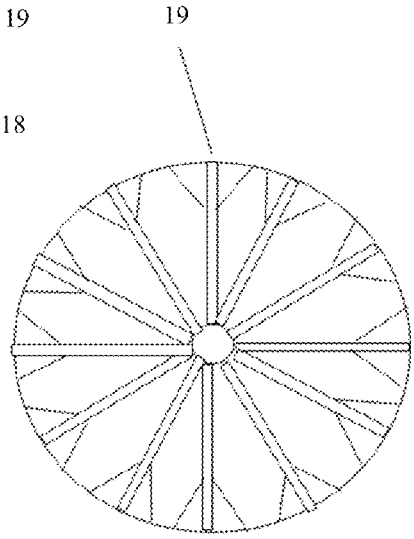
FIG. 9B is a schematic illustration of cooling channels in a piston in accordance with the invention.

As FIGS. 9A and 9B show, the piston 7 is connected to a piston rod. A cooling channel 19 extends through the piston rod and the piston 7. This cooling channel 19 extends from an opening 25 in the region of the first chamber 5 to at least one opening 26 in the region of the second chamber 6. Furthermore a check valve 18 is disposed in the cooling channel 19, which check valve prevents a backflow from the second chamber 6 into the first chamber 5. Thereby the piston 7 is cooled. The opening 26 of the cooling channel 19 into the second chamber 6 is preferably directed toward the inner wall of the cylinder 7, in order to cool it and thus the guide region of the piston 7.

A cylinder cooler 4 is arranged around the cylinder 1. Either the cylinder 1 is cooled in a conventional manner with a cooling liquid or else also with a partial flow or the total flow of the displaced air from the lower first chamber 5 of the cylinder 1 in the first cycle.

In the illustrated first exemplary embodiment, the cylinder cooler 4 is formed by channels that run in the jacket of the cylinder and connect the first chamber 5 to the second chamber 6. In the first cycle, a partial flow of the air from the first chamber 5 flows through them, wherein the flow is controlled by the valve devices assigned to the at least one air channel 13*a*.

Alternatively, the channels for the cylinder cooling in the jacket of the cylinder 1 can also form the air channels 13*a* of the heat exchanger 13 or be connected with such channels in series so that the total flow of the air from the first chamber 5 is guided over the cylinder cooler 4. The flow is in this case again controlled by valve devices assigned to the at least one air channel 13*a*.

With a view to a compact construction, the valve devices or, respectively, in the present case the slide valves 3*a* and 3*b* and the heat exchanger 13 are arranged within a radial annular space around the outer circumference of the cylinder 1.

Figure 11:
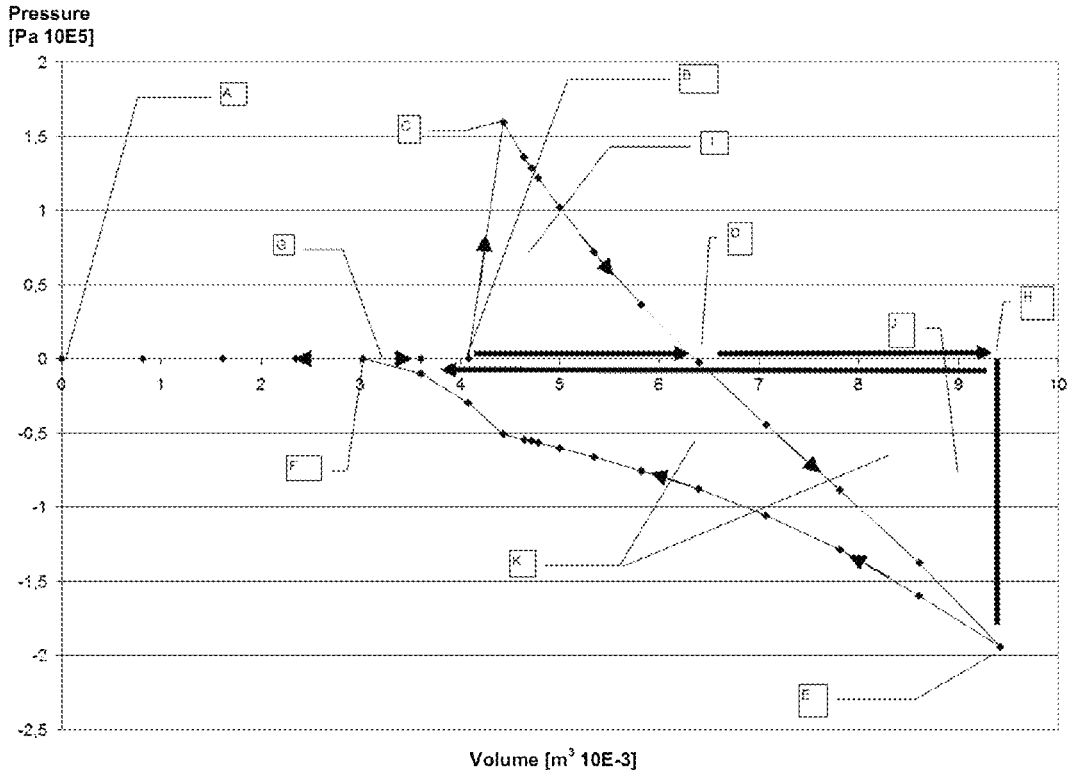
FIG. 11 is a p-V pressure difference diagram for the pressure difference between the second chamber and the first chamber in dependence of the volume of the second chamber in accordance with the invention.

In FIG. 11, the cycles are illustrated in the diagram as a pressure difference (Y-axis) (pressure difference between the upper second chamber 6 and the lower first chamber 5) as a function of the volume of the upper second chamber 6.

Figure 10:
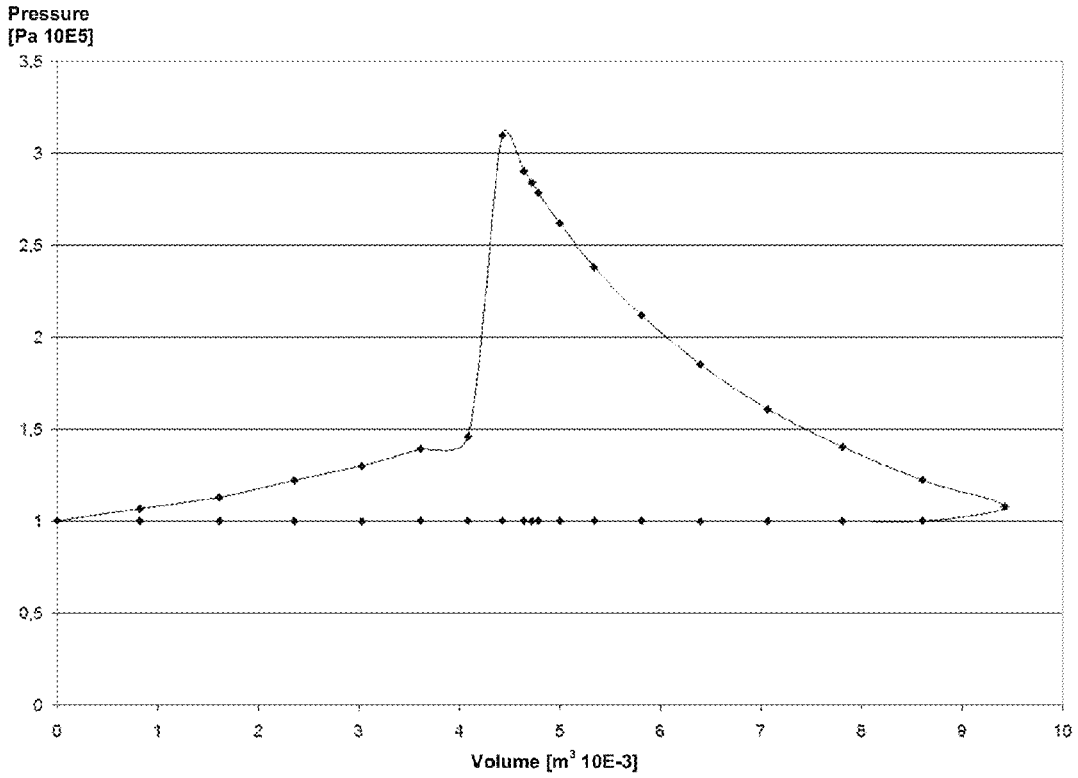
FIG. 10 is a p-V diagram for the second chamber (hot volume) in accordance with the invention.

In FIG. 10, the pressure in the upper second chamber 6 of the cylinder 1 is illustrated as a function of the volume of the space in the upper second chamber 6.

Figure 2:
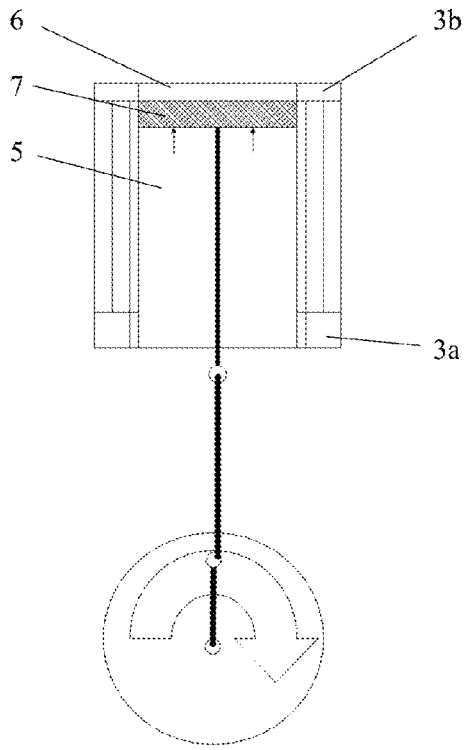
FIG. 2 is a schematic illustration of a motor according to the invention at the beginning of cycle 1.
Figure 3:
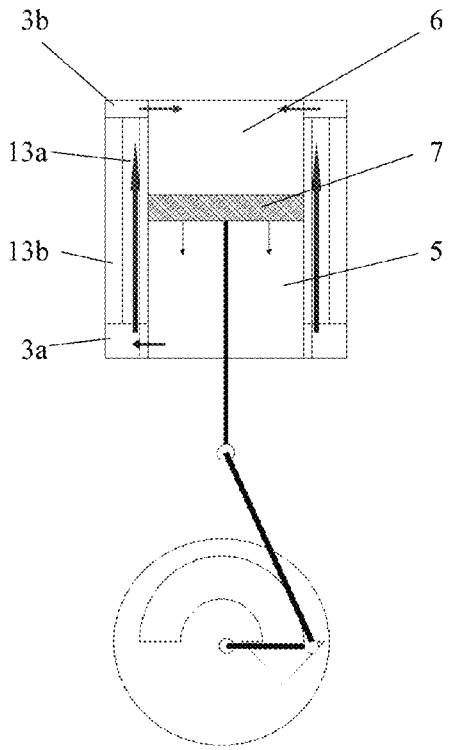
FIG. 3 is a schematic illustration of a motor according to the invention at the end of cycle 1.

The valve devices or, respectively, slide valves 3*a* and 3*b* for controlling the inflows and outflows into the chambers 5 and 6 of the cylinder 1 and in the channels 13*a* and 13*b* of the heat exchanger 13 are controlled such that the following cycles are carried out in succession:

First cycle of the motor: FIG. 2 beginning to FIG. 3 shortly before end; FIG. 11 point A-B The piston 7 is in the top dead center and moves downward. The upper air slide valve 3*b* is open to the air side of the heat exchanger 13, i.e. to the at least one air channel 13*a*, and the lower slide valve 3*a* is also open to the air side of the heat exchanger 13, i.e. to the at least one air channel 13*a*. With the downward movement of the piston 7, the cold air in the cold lower volume or, respectively, the first chamber 5 is displaced and pushed into the heat exchanger. Furthermore, the hot upper volume or, respectively, the second chamber 6 becomes larger and heated air flows from the heat exchanger 13 into the hot upper volume or, respectively, the second chamber 6. Due to the heating of the air, the pressure rises in the upper and lower volume, i.e. in the chambers 5 and 6. Since the pressure is the same in both chambers 5 and 6, no work is needed from the crankshaft 2 or transmitted to the crankshaft 2 in this cycle, only the friction has to be overcome.

This cycle is also referred to as the "thermocompression cycle." The pressure is increased only by an increase in temperature, and not by a reduction in the volume.

In this cycle, fuel can also be introduced in front of the heat exchanger, after the heat exchanger or in the combustion chamber. The fuel must be such that it cannot self-ignite.

Figure 4:
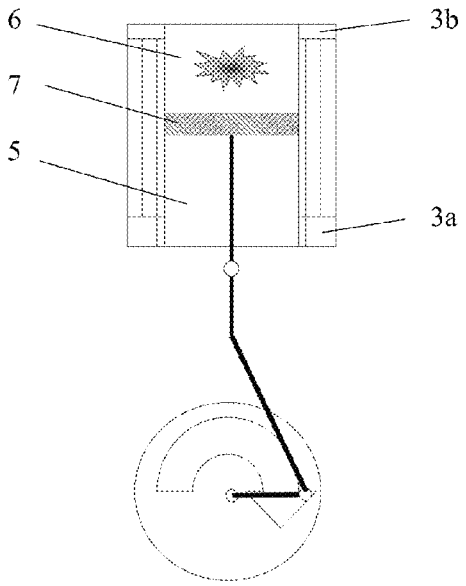
FIG. 4 is a schematic illustration of a motor according to the invention at the beginning of cycle 2.

Second cycle: FIG. 4 beginning to FIG. 5 end; FIG. 11 point B-E

After approximately 40° to 80° of crankshaft revolution, the upper air slide valve 3*b* and the lower slide valve 3*a* are closed. Fuel is introduced, provided that it has not been introduced in the first cycle. In addition, the fuel must be ignited with the help of a suitable ignition (e.g. spark plug, pilot injection as with the Otto motor) or it must self-ignite (as with the diesel motor).

Thereupon, the hot gas in the upper volume or, respectively, the second chamber 6 of the cylinder 1 is expanded due to the downward movement of the piston 7 and the cold gas in the lower volume or, respectively, the first chamber 5 of the cylinder 1 is compressed.

Since the pressure in the upper second chamber 6 is substantially higher than in the lower first chamber 5, work is delivered to the crankshaft 2.

From a certain crankshaft angle on, the pressure in the upper volume or, respectively, the second chamber 6 is equal to the pressure in the lower volume or, respectively, the first chamber 5 (point D in FIG. 11). From this crank angle on, the crankshaft 2 must deliver work. This compression work is however recovered in the third cycle. In the lower volume or, respectively, the first chamber 5 of the cylinder 1 is a residual space at the bottom dead center, the size of which must be determined by mechanical and thermodynamic aspects.

The upper exhaust gas slide valve 3*b* is thus controlled and opened to the exhaust gas side of the heat exchanger 13, when the pressure in the upper volume or, respectively, the second chamber 6 of the cylinder 1 is equal to the pressure after the heat exchanger 13 and the piston has overcome the bottom dead center or the piston 7 is at the bottom dead center. An end 21 of the exhaust-gas-side heat exchanger 13 or, respectively, of the at least one exhaust gas channel 13*b* thereof is open to the environment or, respectively, connected to an exhaust collector or turbocharger.

Figure 5:
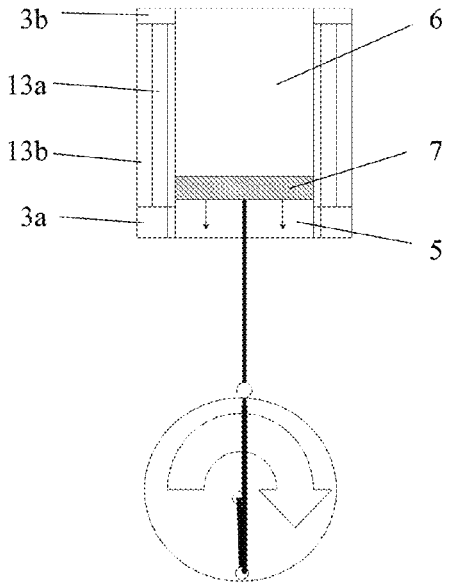
FIG. 5 is a schematic illustration of a motor according to the invention at the end of cycle 2.

Third cycle: FIG. 5 beginning to FIG. 6; FIG. 11 point E-F

The third cycle begins at the bottom dead center or after the dead center of the piston 7. The upper exhaust gas slide valve 3*b* is open to the exhaust gas side of the heat exchanger 13 and with the upward movement of the piston 7 the exhaust gas is pushed through the heat exchanger 13. The lower slide valve 3*a* remains closed. The compressed air in the lower volume or, respectively, in the first chamber 5 of the cylinder 1 expands and performs work at the crankshaft 2.

Fourth cycle: FIG. 7 to FIG. 2 end; FIG. 11 point F-A

After about 280° to 320° of crankshaft revolution or when the lower cylinder pressure is equal to the ambient air pressure or pressure at the intake port, the lower slide valve 3*a* opens to the environment and draws in fresh air from the environment or, respectively, via an intake device 22, such as an intake port, until reaching the top dead center. As with the Otto motor or the diesel motor, it does not have to be exactly the top dead center. The upper exhaust gas slide valve 3*b* is still open to the exhaust gas side of the heat exchanger 13, i.e. to the at least one exhaust gas channel 13*b*.

FIG. 8 shows the positions of the slide valves 3*a* and 3*b*. The specified angles are approximate values for the angle of rotation of the crankshaft, which corresponds to the position of the piston 7. These angles can be optimized by thermodynamic and fluid-dynamic calculations.

In the exemplary embodiment explained above, there is a power cycle for each crankshaft revolution of 360° (cycle 2). However, as will be explained below with reference to another exemplary embodiment, after the first cycle, a compression cycle can additionally be introduced, whereupon the power cycle, i.e. the above-explained second cycle, follows. The second cycle may in this case be performed over a crankshaft angle of up to 180° after the compression cycle. The same components in the second exemplary embodiment are identified by the same reference characters.

Figure 13:
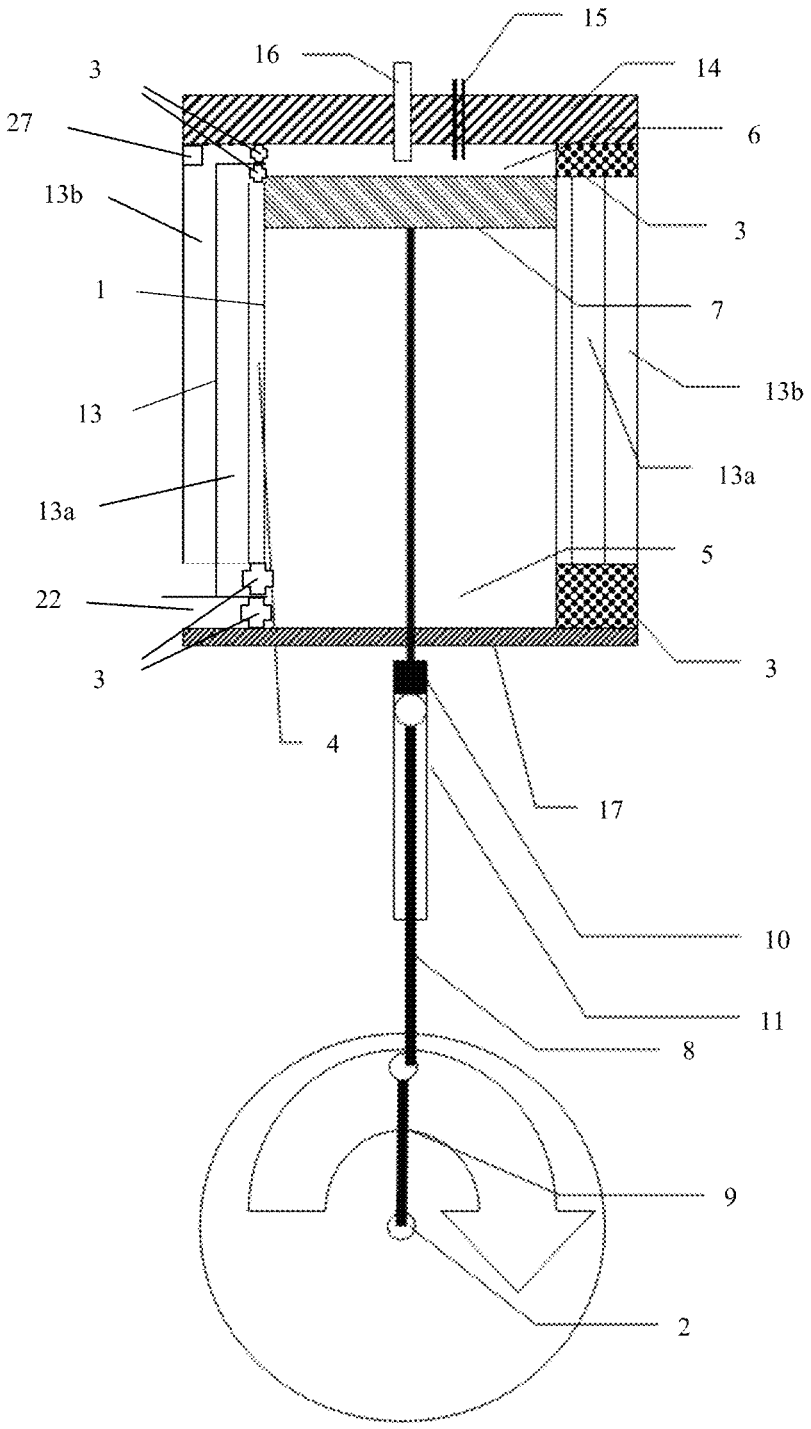
FIG. 13 is a diagrammatic sectional view of a motor according to a second exemplary embodiment of the invention.
Figure 14:
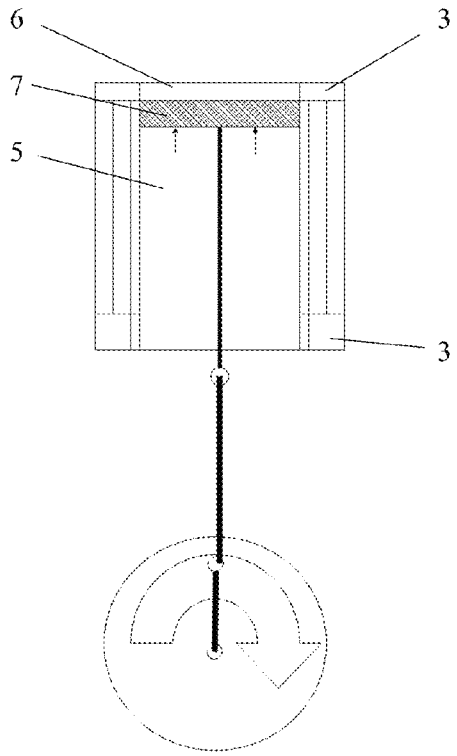
FIG. 14 is a schematic illustration of a motor according to the invention at the beginning of cycle 1.
Figure 15:
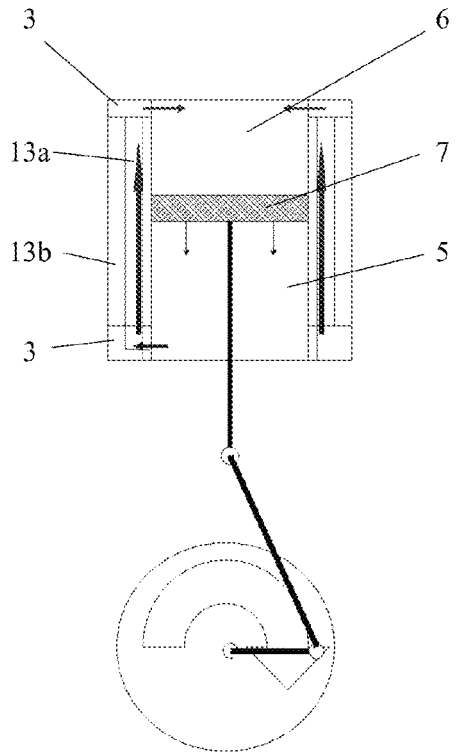
FIG. 15 is a schematic illustration of a motor according to the invention at the end of cycle 1.
Figure 16:
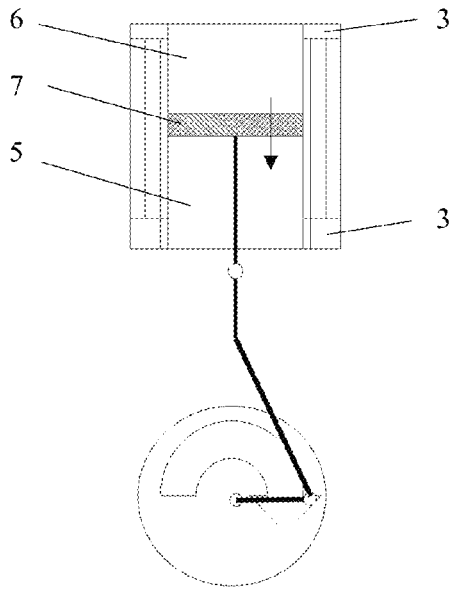
FIG. 16 is a schematic illustration of a motor according to the invention at the beginning of the compression cycle.
Figure 17:
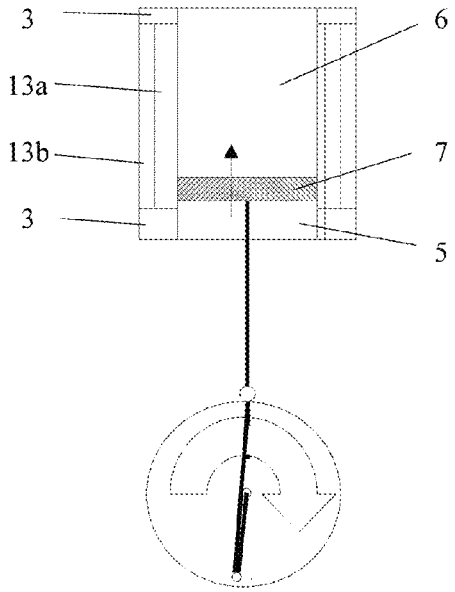
FIG. 17 is a schematic illustration of a motor according to the invention during the further course of the compression cycle.
Figure 18:
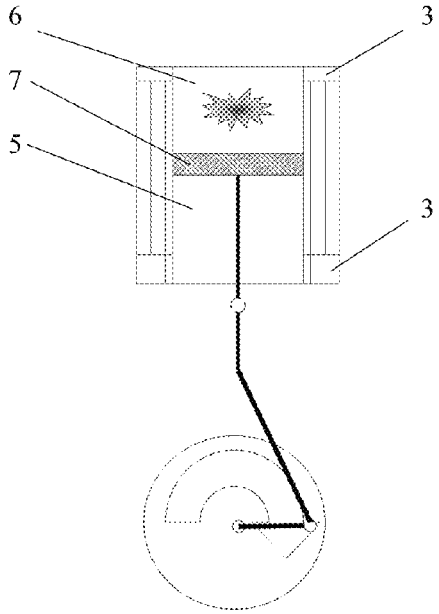
FIG. 18 is a schematic illustration of a motor according to the invention at cycle 2.
Figure 19:
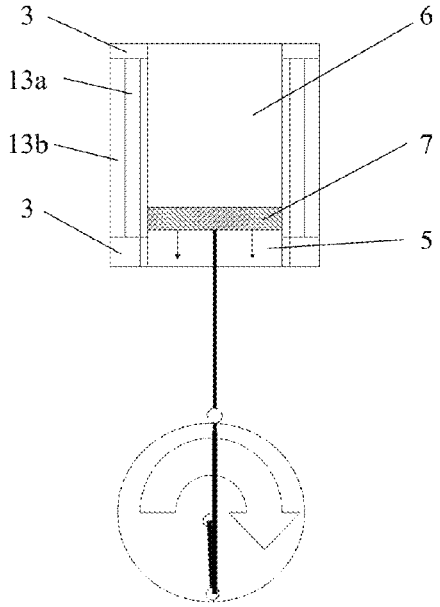
FIG. 19 is a schematic illustration of a motor according to the invention at the end of cycle 2.

The thermocompression motor of the second exemplary embodiment illustrated in FIG. 13 has a cylinder 1, in which a piston 7 is guided in a slidably movable manner. The piston 7, which is movable in a reciprocating manner, divides an interior space of the cylinder 1 into a first chamber 5 and a second chamber 6. The motor further includes a heat exchanger 13 with at least one air channel 13*a* and at least one exhaust gas channel 13*b*. The air channel 13*a* connects the first chamber 5 with the second chamber 6. The exhaust gas channel 13*b* connects the second chamber 6 with the external environment. The at least one air channel 13*a* and the at least one exhaust gas channel 13*b* are in this case arranged with respect to one another such that a heat exchange is possible. A counter-current configuration is illustrated in the present case. A co-current configuration or cross-current configuration is however also possible, the counter-current configuration is however most effective. Further, an intake device 22 is provided, via which the first chamber 5 is connected to the external environment, in order to suck in fresh air.

The thermocompression motor furthermore has valve devices, which are designated in a general manner by the reference character 3, for controlling the inflows and outflows into the chambers 5 and 6 of the cylinder and into the channels 13*a* and 13*b* of the heat exchanger 13. The valve devices 3 can be embodied as slide valves as in the first exemplary embodiment. However, other valve types can be used, for example pushrods controlled by the crankshaft or individually controllable magnetic valves. The valve devices 3 are controlled in a manner to successively execute the cycles illustrated in FIGS. 14 to 21. The respective positions of the valve devices are specified in FIG. 22.

In a first cycle or, respectively, thermocompression cycle (see FIGS. 14 and 15), during a reduction in volume of the first chamber 5, the first chamber 5 is connected to the second chamber 6 via the at least one air channel 13*a* of the heat exchanger 13. At the same time, an inflow of fresh air via the intake device 22 into the first chamber 5 as well as an outflow from the second chamber 6 into the at least one exhaust gas channel 13*b* is interrupted. As a result of the piston movement, air is expelled from the first chamber 5 into the at least one air channel 13*a* of the heat exchanger 13. Furthermore, air heated by the exhaust gas channel 13*b* is conveyed from the at least one air channel 13*a* into the second chamber 6. The volume of the air channel 13*a* is dimensioned so that a sufficient heating is possible for the purpose of thermal compression.

As in the first exemplary embodiment, the first cycle may be followed by the above described second cycle. In the present case, however, a compression cycle (see FIGS. 16 and 17) is inserted, in which all valve devices 3 are kept closed for a reciprocating back and forth movement of the piston 7.

Afterwards the second cycle follows (see FIGS. 18 and 19) as the power cycle, wherein the combustion can begin at or already shortly before or after overcoming the dead center of the piston 7. The start of combustion can lie in a range from about 10° to a maximum of 30° before the dead center to 10° to a maximum of 40° after this dead center. During the expansion of the second chamber 6 or, respectively, the reduction in volume of the first chamber 5, the connection between the at least one air channel 13*a* and the second chamber 6 is closed. The inflow to the first chamber 5 remains interrupted.

The first chamber 5 is configured such that at the dead center of the piston 7, at a minimum volume of the first chamber 5, in FIG. 13 the bottom dead center, a defined residual space remains in which compressed air can act as a gas spring.

At the transition from the second cycle to the third cycle, the connection of the second chamber 6 to the at least one exhaust gas channel 13*b* is opened, and preferably at the time when the piston 7 is at the dead center at a minimum volume of the first chamber 5, i.e. in FIG. 13 at the bottom dead center, or when the pressure in the second chamber 6 is equal to the pressure after the heat exchanger 13 and the piston 7 is at or after the bottom dead center.

Figure 20:
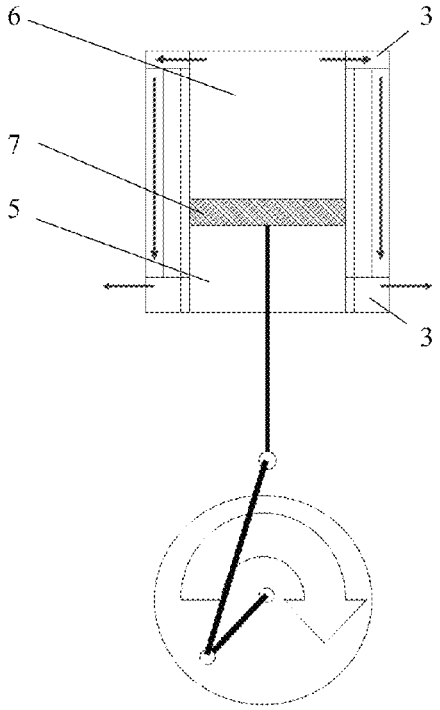
FIG. 20 is a schematic illustration of a motor according to the invention at cycle 3.
Figure 21:
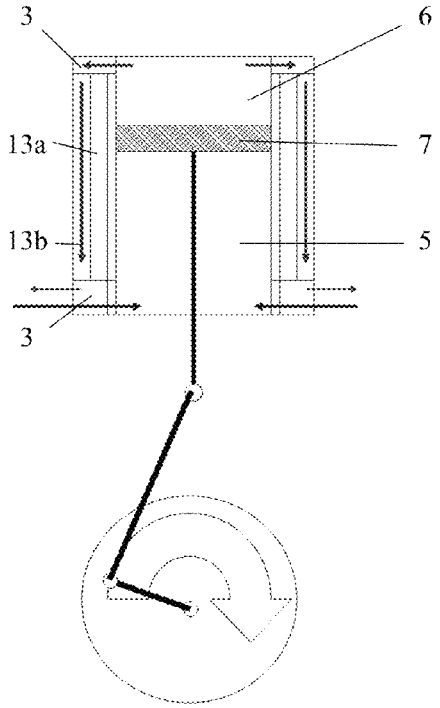
FIG. 21 is a schematic illustration of a motor according to the invention at cycle 4.

In the third cycle (see. FIG. 20), i.e. during a subsequent increase in the volume of the first chamber 5, only the connection of the second chamber 6 to the exhaust passage 13*b* is open.

The transition to the fourth cycle, in which fresh air is sucked in, takes place when the pressure in the first chamber 5 is equal to the pressure in front of that valve device which controls the flow to the first chamber 5 or when a defined piston position in the cylinder is reached. The connection to the intake device 22 is opened for that purpose. In the fourth cycle (see FIG. 21), in which a further increase in the volume of the first chamber 5 occurs, fresh air can thus be sucked into the first chamber 5. At the same time, the connection between the first and second chamber via the at least one air channel 13 is interrupted.

Otherwise, the motor of the second exemplary embodiment can be configured according to the first exemplary embodiment.

In both cases, the amount of fuel supplied via the fuel feed device 16 can be metered by a microprocessor-controlled device, which is schematically shown as a control device in FIG. 1, as a function of the expulsion temperature, in order to improve the efficiency and to protect the heat exchanger 13 from damage. The expulsion temperature can for example be measured by means of a sensing element 27 in the exhaust gas during the expulsion from the second chamber 6 into the at least one exhaust gas channel 13*b* of the heat exchanger 13.

Furthermore, the quantity of fresh air supplied to the first chamber 5 can be metered by a microprocessor-controlled intake device 22 as a function of the ambient constant pressure, namely, for example, such that the combustion gas after the expansion has the same pressure as after the heat exchanger 13.

The efficiency of the above-described thermocompression motors is improved compared to conventional heat engines with an open cycle process in that the exhaust gas heat is utilized very efficiently, because the combustion air is first pushed uncompressed through the heat exchanger 13, so that the combustion air temperature at the inlet of the heat exchanger 13 is cold and a large thermal gradient can be used. When pushing the cold air over, there is only a small thermal compression. Because the heat exchanger 13 is supplied with relatively cold air on the cold side, i.e. in the at least one air channel 13*a*, the exhaust gas can be cooled considerably. This large waste heat utilization greatly increases the efficiency. In comparison to this, in a gas turbine process with a regenerator, the compressed air and thus hotter air is pushed through the regenerator, as a result of which the efficiency of the regenerator is reduced.

The motor can process the working medium, i.e. the hot gas in the upper volume or, respectively, the second chamber 6 of the cylinder, down to ambient pressure. In a diesel motor or in an Otto motor at full load, the pressure in the cylinder at the beginning of the expulsion of the exhaust gas is significantly higher than the ambient pressure. This excess pressure is then partly used again in the turbocharger. Without a turbocharger, this energy is lost in the diesel motor and the Otto motor.

LIST OF REFERENCE CHARACTERS

1 piston
2 crankshaft
3*a* inlet slide valve
3*b* outlet slide valve
4 cylinder cooler
5 first chamber or, respectively, lower volume of the cylinder
6 second chamber or, respectively, upper volume of the cylinder
7 piston
8 connecting rod
9 crank web
10 crosshead
11 crosshead guide
13 heat exchanger
13*a* air channel
13*b* exhaust gas channel
14 cover with insulation
15 ignition (in case of fuel for spark-ignition motor)
16 fuel feed device
17 base
18 check valve
19 cooling channel
20 sealing strips/sliding strips/piston rings
21 exhaust gas outlet from upper cylinder from the hot side of the heat exchanger
22 intake device for air intake from outside
23 slots in the cylinder wall
24 cold air from lower cylinder into cold side of the heat exchanger
25 bore hole or elongated hole
26 opening towards cylinder wall, openings are above the sealing strips/sliding strips/piston rings
27 sensing element
A top dead center
B lower and upper slide valve are closed, at the top fuel is fed or, respectively, fuel is ignited
C maximum pressure difference at top
D equal pressures at top and bottom
E bottom dead center
F lower volume of the cylinder: air intake from outside, upper volume of the cylinder, expulsion of the flue gas, piston moves upwards
G cold air is pushed through the heat exchanger from the bottom to the top, pressure at the bottom and at the top are equal
H point H
I work to crankshaft due to higher pressure at top than at bottom, piston moves downward, work=area B-C-D-B
J work from crankshaft due to higher pressure at bottom than at top, piston moves downward, work=area D-E-H-D
K work from crankshaft due to higher pressure at bottom than at top, piston moves upward, recovery of the compression work, the enclosed area represents the performed work=area F-H-E-F

The invention claimed is:

1. A thermocompression motor, comprising:
a cylinder;
a piston, which is disposed reciprocatingly movable in said cylinder and which divides said cylinder into a first chamber and a second chamber;
a heat exchanger having at least one air channel, which connects said first chamber with said second chamber, and having at least one exhaust gas channel, which connects said second chamber with an external environment, said at least one air channel and said at least one exhaust gas channel being disposed with respect to one another to allow a heat exchange;
an intake device via which said first chamber is connected to the external environment; and
valve devices for controlling inflows and outflows in said first chamber and said second chamber of said cylinder and in said at least one air channel and said at least one exhaust gas channel of said heat exchanger, said valve devices being controlled such that the following cycles are carried out in succession, namely:
in a thermocompression cycle as a first cycle, during a volume reduction of said first chamber, said first chamber is connected with said second chamber via said at least one air channel, whereby air from said first chamber is expelled into said heat exchanger and heated air from said heat exchanger is conveyed into said second chamber, an inflow via said intake device into said first chamber as well as an outflow from said second chamber into said at least one exhaust gas channel is however interrupted;

subsequently, in a second cycle, during a volume reduction of said first chamber, a connection between said at least one air channel and said second chamber is closed and fuel that has been introduced is burned in said second chamber, wherein an inflow to said first chamber is still interrupted;

in a third cycle, during a subsequent volume increase of said first chamber, only a connection of said second chamber to said at least one exhaust gas channel is open; and in a fourth cycle, during a further volume increase of said first chamber, an inflow thereto via said intake device is opened, while a connection between said first chamber and said second chamber via said at least one air channel is interrupted.

2. The thermocompression motor according to claim 1, wherein a compression cycle is inserted between the first cycle and the second cycle, in which for a reciprocating movement of said piston all of said valve devices are kept closed, and a combustion in the second cycle starts at a time selected from the group consisting of a time shortly before a dead center of said piston, at the dead center of said piston, and after overcoming the dead center of said piston.

3. The thermocompression motor according to claim 1, wherein said first chamber has a given residual space at a dead center of said piston at a minimum volume of said first chamber.

4. The thermocompression motor according to claim 1, wherein said valve devices are controlled such that at a transition from the second cycle to the third cycle the connection of said second chamber to said at least one exhaust gas channel is opened at or after a dead center at a minimum volume of said first chamber, when a pressure in said second chamber is equal to a pressure after said at least one exhaust gas channel of said heat exchanger.

5. The thermocompression motor according to claim 1, wherein said valve devices are controlled such that in the fourth cycle, a connection to said intake device is opened when a pressure in said first chamber is equal to a pressure in front of a corresponding one of said valve devices.

6. The thermocompression motor according to claim 1, wherein at least one of said valve devices is embodied as a slide valve.

7. The thermocompression motor according to claim 1, wherein one of said valve devices is embodied as a slide valve controlling both an inflow and an outflow of said first chamber.

8. The thermocompression motor according to claim 1, wherein one of said valve devices is embodied as a slide valve controlling both an inflow and an outflow of said second chamber.

9. The thermocompression motor according to claim 1, wherein said valve devices are embodied as a first slide valve and a second slide valve, said first slide valve controls both an inflow and an outflow of said first chamber and said second slide valve controls both an inflow and an outflow of said second chamber.

10. The thermocompression motor according to claim 1, wherein:

said valve devices are embodied as a first slide valve and a second slide valve, said first slide valve controls both an inflow and an outflow of said first chamber and said second slide valve controls both an inflow and an outflow of said second chamber;

said heat exchanger is fixedly connected to at least one of said slide valves and is disposed rotatably around said cylinder; and said cylinder has a cylinder wall, a base and a cover, at least one cylinder element selected from the group consisting of said cylinder wall, said base and said cover has openings formed therein, and a gas exchange through corresponding ones of said openings is controlled in dependence of a rotational position of said heat exchanger with respect to said cylinder.

11. The thermocompression motor according to claim 1, including a microprocessor-controlled device for metering a quantity of supplied fuel as a function of an expulsion temperature, the expulsion temperature being a temperature of exhaust gas during expulsion from said second chamber into said at least one exhaust gas channel of said heat exchanger.

12. The thermocompression motor according to claim 1, wherein said intake device is a microprocessor-controlled intake device for metering a quantity of fresh air supplied to said first chamber as a function of an ambient constant pressure, wherein the metering occurs such that a combustion gas has a pressure after an expansion equal to a pressure after said heat exchanger.

13. The thermocompression motor according to claim 1, including:

a piston rod connected to said piston;

a cooling channel running through said piston rod and said piston, said cooling channel having a first opening in a region of said first chamber and having at least a second opening in a region of said second chamber, said cooling channel extending from said first opening in the region of said first chamber to said second opening in the region of said second chamber; and a check valve disposed in said cooling channel, said check valve being configured to prevent a backflow from said second chamber into said first chamber.

14. The thermocompression motor according to claim 1, including:

a piston rod connected to said piston;

a cooling channel running through said piston rod and said piston, said cooling channel having an opening in a region of said first chamber and having a plurality of openings in a region of said second chamber, said cooling channel extending from said opening in the region of said first chamber to said plurality of openings in the region of said second chamber;

a check valve disposed in said cooling channel, said check valve being configured to prevent a backflow from said second chamber into said first chamber; and said cylinder has an inner wall, at least one of said plurality of openings in the region of said second chamber being directed toward said inner wall of said cylinder.

15. The thermocompression motor according to claim 1, wherein said cylinder has a jacket with channels extending therethrough, said channels form a cylinder cooler, said channels connect said first chamber with said second chamber and are flowed through by a partial flow of air from said first chamber in the first cycle, wherein said valve devices assigned to said at least one air channel control a flow.

16. The thermocompression motor according to claim 1, wherein said cylinder has a jacket with channels extending therethrough, said channels form a cylinder cooler, said channels connect said first chamber with said at least one air channel of said heat exchanger, wherein a total flow of air from said first chamber is guided over said cylinder cooler, wherein said valve devices assigned to said at least one air channel control a flow.

17. The thermocompression motor according to claim 1, wherein said cylinder has a jacket with channels extending therethrough, said channels form said at least one air channel connecting said first chamber with said second chamber, said channels form a cylinder cooler, wherein a total flow of air from said first chamber is guided over said cylinder cooler, wherein said valve devices assigned to said at least one air channel control a flow.

18. The thermocompression motor according to claim 1, wherein said valve devices and said heat exchanger are disposed within a radial annular space flat around an outer periphery of said cylinder.

19. A method for operating a thermocompression motor, the method which comprises:

providing a piston disposed reciprocatingly movable in a cylinder, wherein the piston divides the cylinder into a first chamber and a second chamber;

providing a heat exchanger with at least one air channel, which connects the first chamber with the second chamber, and with at least one exhaust gas channel, which connects the second chamber with an external environment, wherein the at least one air channel and the at least one exhaust gas channel are disposed with respect to one another to allow a heat exchange;

providing an intake device via which the first chamber is connected to the external environment; and providing valve devices for controlling inflows and outflows in the first chamber and the second chamber of the cylinder and in the at least one air channel and the at least one exhaust gas channel of the heat exchanger, wherein the valve devices are controlled such that the following cycles are carried out in succession:

in a thermocompression cycle as a first cycle, connecting, during a volume reduction of the first chamber, the first chamber with the second chamber via the at least one air channel, whereby air from the first chamber is expelled into the heat exchanger and heated air from the heat exchanger is conveyed into the second chamber, an inflow via the intake device into the first chamber as well as an outflow from the second chamber into the at least one exhaust gas channel is however interrupted;

subsequently, in a second cycle, keeping a connection between the at least one air channel and the second chamber closed during a volume reduction of the first chamber and burning fuel, which has been introduced, in the second chamber, wherein an inflow to the first chamber is still interrupted;

in a third cycle, keeping only a connection of the second chamber to the at least one exhaust gas channel open during a subsequent volume increase of the first chamber; and in a fourth cycle, during a further volume increase of the first chamber, opening an inflow to the first chamber via the intake device, while interrupting a connection between the first chamber and the second chamber via the at least one air channel.

* * * * *